US006302164B1

(12) United States Patent
Nitecki et al.

(10) Patent No.: US 6,302,164 B1
(45) Date of Patent: Oct. 16, 2001

(54) SYSTEM FOR DISPENSING LIQUID HYDROCARBONS FITTED WITH A VAPOR RECOVERY MEANS

(75) Inventors: Jean-Pierre Nitecki, Buc; Jacques Fournier, Bretigny sur Orge, both of (FR)

(73) Assignee: Tokheim Services France, Le Plessis Robinson (FR)

( * ) Notice: Subject to any disclaimer, the term of this patent is extended or adjusted under 35 U.S.C. 154(b) by 0 days.

(21) Appl. No.: 09/536,136

(22) Filed: Mar. 28, 2000

(30) Foreign Application Priority Data

Mar. 31, 1999 (FR) ..... 99 04018

(51) Int. Cl.[7] ..... B65B 31/00
(52) U.S. Cl. ..... 141/45; 141/44; 141/59
(58) Field of Search ..... 141/44, 45, 59, 141/83, 100, 103, 285, 290, 392

(56) References Cited

U.S. PATENT DOCUMENTS

| | | | | |
|---|---|---|---|---|
| 3,763,901 | * | 10/1973 | Viland | 141/8 |
| 3,881,894 | * | 5/1975 | Onufer | 55/88 |
| 3,913,633 | * | 10/1975 | Hiller | 141/45 |
| 4,092,137 | * | 5/1978 | Howe et al. | 55/337 |
| 4,200,443 | * | 4/1980 | Marjollet et al. | 55/347 |
| 4,467,826 | * | 8/1984 | Lorentz | 137/188 |
| 5,038,838 | * | 8/1991 | Bergamini et al. | 141/59 |
| 5,256,171 | * | 10/1993 | Payne | 95/19 |
| 5,513,680 | * | 5/1996 | Hilliard, Jr. et al. | 141/4 |
| 5,550,532 | * | 8/1996 | Marshall | 141/186 |
| 5,832,713 | * | 11/1998 | Maese et al. | 60/39.02 |
| 5,878,792 | * | 3/1999 | Pettazzoni et al. | 141/59 |
| 6,000,426 | * | 12/1999 | Tuckey et al. | 137/588 |
| 6,047,745 | * | 4/2000 | Fournier | 141/59 |
| 6,102,085 | * | 8/2000 | Nanaji | 141/59 |
| 6,176,275 | * | 1/2001 | Hill | 141/59 |

FOREIGN PATENT DOCUMENTS

| | | | |
|---|---|---|---|
| 41 39 844 | | 6/1993 | (DE) . |
| 0 486 910 | | 5/1992 | (EP) . |
| 9142598-A | * | 6/1997 | (JP) . |
| 9240799-A | * | 9/1997 | (JP) . |

* cited by examiner

*Primary Examiner*—Steven O. Douglas
*Assistant Examiner*—Khoa Huynh
(74) *Attorney, Agent, or Firm*—Drinker Biddle & Reath LLP

(57) ABSTRACT

A system for dispensing liquid hydrocarbons includes a vapour recovery circuit having a vapour/liquid separator and a vapour flow controller. The vapour/liquid separator has a receiving chamber in which liquid is collected and is mounted in the vapour recovery circuit upstream of the vapour flow controller. The recovery chamber is connected to a bleeding pipe having an inlet fitted with a non-return valve.

10 Claims, 1 Drawing Sheet

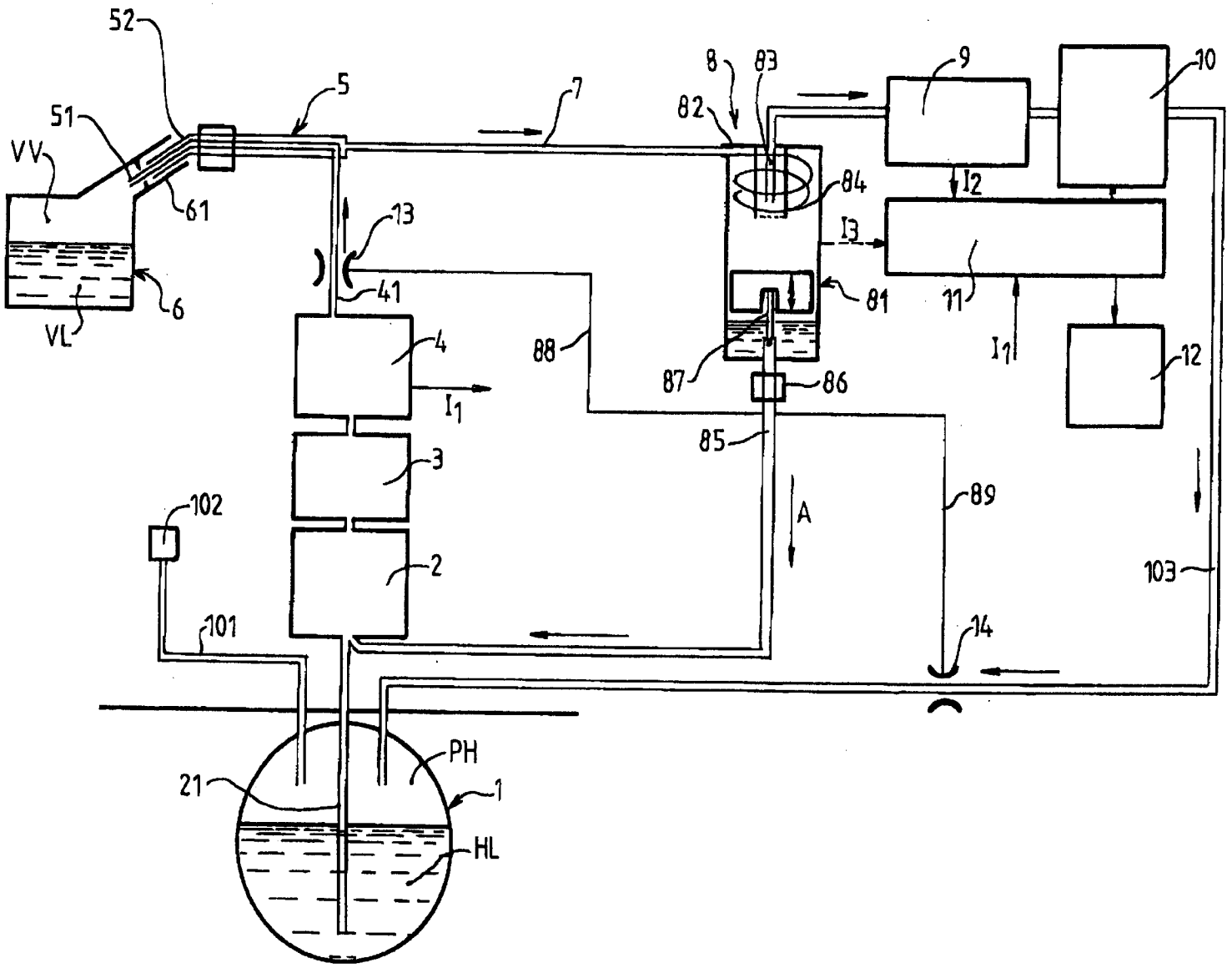
10
12
103
9
12
11
I1
89
14
84
I3
81
86
A
83
8
82
87
85
7
88
I1
4
3
2
PH
1
HL
13
41
5
21
52
61
6
102
101
51
VV
VL

SYSTEM FOR DISPENSING LIQUID HYDROCARBONS FITTED WITH A VAPOR RECOVERY MEANS

The present invention relates to a system for dispensing hydrocarbons from a storage tank comprising:

- a pump followed by a liquid/gas separator connected to a device for measuring liquid upstream of a dispensing valve,
- a circuit for recovering hydrocarbon vapour, connected to the dispensing valve to pick up the hydrocarbon vapour at the outlet of the tank during filling, this valve being connected to a vapour suction pump, the output of which is connected to the storage tank,
- a control unit connected to the device for measuring the liquid volume and to the vapour flow controller as well as the vapour pump to control the flow of vapour depending on the rate at which the liquid is dispensed by the valve.

Both national and international regulations governing air protection require hydrocarbon vapours emitted to the exterior of motor vehicle tanks (into the air) during filling operations to be eliminated or recovered.

The volume above the liquid in a tank in effect contains hydrocarbon vapour. In accordance with current regulations, these vapours must be recovered and recovery requirements are becoming increasingly stringent since in some cases these vapours must be recovered with losses of less than 5%.

Due to the fact that recovery is effected on a level with the dispenser valve (gun), and shut-down of the dispenser is generally controlled by liquid rising in the supply sleeve of the vehicle tank, it may be that some liquid is sucked in by the vapour recovery system This is not satisfactory because it disrupts operation of the suction and vapour recovery system. If the dispenser valve does not automatically close as liquid reaches the level of the vehicle tank, it may be sucked in.

Finally, depending on the operating conditions of the system and the state of the vehicle (vehicle may be hot in summer, pipework cold), recovered vapour condenses in the cold pipe of the vapour recovery circuit. Condensates build up and disrupt operation of the means controlling vapour flow downstream of this control means.

The objective of this invention is to overcome these disadvantages and it in effect relates to a dispensing system of the type outlined above, characterised by a vapour/liquid separator having a receiving chamber which collects the liquid, this separator being mounted in the vapour recovery circuit upstream of the vapour flow controller, and the recovery chamber is connected to a bleeding pipe, the inlet of which is fitted with a non-return valve.

As there is no longer any risk of the vapour suction pump taking in condensates, it is able to operate very accurately and efficiently, sucking in a volume of gas (vapours) from the tank corresponding to the volume of liquid simultaneously introduced into it by the dispensing valve.

By virtue of another advantageous feature, the vapour outlet of the vapour/liquid separator has a particle filter.

Another advantageous feature is provided whereby the vapour/liquid separator consists of a chamber with a centrifugal effect having an inlet arranged at a tangent connected to the vapour pipe, which is in turn connected to the dispensing valve, a base into which the bleeding pipe opens and, in the top part, a drawing-off tube is provided at the centre of the chamber.

The system also has a control unit which receives data from the separator in order to check that it is operating correctly Due to another advantageous feature, the vapour/liquid separator has a float which controls opening of the bleeding pipe depending on the level of liquid collected in the chamber.

By virtue of another advantageous feature, the drainage pipe is very small in diameter so that it is able to operate as a flame arrester.

As a result of other practical features:

- the base of the separator chamber is connected to a venturi, mounted in the pipe connecting the measuring device to the dispensing valve;
- the bleeding pipe is connected to the intake of the pump;
- the base of the separator chamber is connected to a venturi mounted in a pipe linking the output of the vapour pump to the tank;
- the float in the separator is fitted with a level sensor, selected from the group comprising a magnet and contact pin sensor, a Hall-effect or optical fibre sensor or an optical coupler.

The invention will be described in more detail below with reference to the single appended drawing, which is a diagram of the system for dispensing liquid hydrocarbons as proposed by the invention.

As may, be seen from the drawing, the invention relates to a hydrocarbon dispensing unit comprising a storage tank 1, disposed underground, containing a volume of liquid hydrocarbons HL with a vapour phase PH above and a venting pipe 101 fitted with a safety valve 102. The suction pipe 21 of a suction pump 2 is immersed in the liquid HL in the tank 1. This pump 2 is connected at its output to a liquid/gas separator 3, which allows gas and vapour dissolved in the pumped liquid to escape so that a device for measuring liquid volume 4 downstream of the separator 3 will receive and measure only liquid. This measuring device supplies the gun or dispensing valve 5. In the drawing, it is shown engaged in the end-piece 61 of a tank 6 of a motor vehicle. The measuring device supplies data $I_1$ as a measurement signal which is used in the control unit of the system and to display the volume dispensed along with the price on a display unit.

The tank 6 contains a volume of liquid VL above which is a volume of vapour VV. The gun (dispensing valve) 5 has a pipe 51 for the liquid and an auxiliary pipe 52 to recover. vapour displaced from the vapour volume VV as the level of the liquid volume VL rises.

This vapour pipe 52 is connected to the hydrocarbon vapour recovery circuit consisting of a pipe 7 connected to a vapour/liquid separator 8, which operates on the basis of the centrifuge principle. This separator 8 consists of a chamber 81 into the inlet 82 at the top part of which the vapour pipe 7 runs, disposed at a tangent to the inlet 82. Arranged at the center of this chamber 81 is an extraction pipe 83 protected by a particle filter 84. Opening into the base of the chamber 81 is a drainage pipe 85 fitted with a non-return valve 86 which opens only in the direction of arrow A so as to discharge liquid from the chamber 81. Due to a centrifugal effect, entrained or condensed liquid droplets are ejected with the flow of vapour rotating in the chamber 81 so that they are deposited on and run down the wall of the chamber to collect in the base. Having had the droplets removed, the hydrocarbon vapour is sucked into the central part the extraction pipe 83.

The inlet of the drainage pipe 85 is also closed off by a float valve 87 which opens when enough liquid has accumulated at the bottom of the chamber 81 to lift the float 87. The liquid which has collected at the bottom of the chamber 81 is sucked through the bleeding pipe 85 by the pump 2.

In another embodiment, the condensed liquid is sucked in by a venturi 13 fitted in the pipe 41 connecting the outlet of the measuring device 4 to the dispensing valve 5. Accordingly, this system allows the condensed hydrocarbon vapour to be re-injected directly to the tank 6, from where it is extracted. The venturi 13 is directly connected to the bleeding pipe 85 by a bleeding pipe 88, downstream of the non-return valve 86.

The liquid may also return to the tank 1.

In the case of another embodiment, the condensate is sucked in by a venturi 14 mounted in the pipe 103 and connected by a bleeding pipe or tube 89 to the bleeding pipe 85 downstream of the valve 86 at the outlet of the chamber 81.

The outlet pipe 83 of the separator 8 is connected to a vapour flow controller 9, for example a solenoid or a variable flow pump, which determines the flow rate of vapour, and, downstream of thereof, a suction pump 10. The suction pump 10 creates the under-pressure inside the chamber 81 of the separator 8 so that the vapour phase is sucked in on a level with the gun 5. Vapour sucked in by the pump 10 is returned to the vapour phase PH in the tank 1 via the pipe 103.

A control unit 11 manages operation of the entire system. This control unit 11 receives a flow rate datum $I_1$ from the -device measuring the liquid volume 4 and it (11) issues a control signal that will regulate the flow of vapour sucked in so that it essentially corresponds to the flow rate of liquid being introduced into the tank 6.

The bleeding pipe 85 is connected either to the intake of the liquid suction pump 2 or to the plunger pipe 21. It may also be connected to the venturis 13, 14.

The bleeding pipes 85 and 88, 89 are preferably capillary tubes which are long enough to act as a flame arrester between the separator 8 and the other parts of the system.

The command and control unit 11 also monitors the position of the float 87, to check that it is operating correctly.

To this end, the float is fitted with a level sensor, for example a magnet/contact pins, or a Hall-effect or optical fibre sensor, or an optical sensor (not illustrated).

The invention specifically finds applications in the field of environmental protection against hydrocarbon vapours, particularly in situations where they are dispensed to motor vehicles

What is claimed is:

1. A system for dispensing hydrocarbons from a storage tank comprising:

a pump (2) followed by a liquid/gas (3) separator connected to a device for measuring liquid volume (4) upstream of a dispensing valve (5);

a circuit for recovering hydrocarbon vapour, connected to the dispensing valve (5) to pick up hydrocarbon vapour at an outlet of a tank (6) being filled by the dispensing valve, the dispensing valve (5) being connected to a vapour suction pump (10), the vapour suction pump having an output connected to the storage tank (1), a control unit (11) connected to the device for measuring the liquid volume (4) and to a vapour flow controller (9) as well as the vapour suction pump (10) to control the flow of vapour depending on the rate at which liquid is dispensed by the dispensing valve (5); and a vapour/liquid separator (8) having a receiving chamber (81) for collecting liquid, the vapour/liquid separator being mounted in the vapour recovery circuit upstream of the vapour flow controller (9), the receiving chamber (81) connected to a bleeding pipe (85) having an inlet fitted with a non-return valve (86).

2. A system as claimed in claim 1, wherein the receiving chamber (81) of the vapour/liquid separator (8) has a centrifugal effect, the receiving chamber having an inlet (82) arranged at a tangent and connected to a vapour pipe, which is in turn connected to the dispensing valve (5), the receiving chamber further having a base into which the bleeding pipe (85) opens and a drawing off tube (83) in a top part of the chamber at the center of the chamber.

3. A system as claimed in claim 2, wherein the drawing-off tube (83 has an inlet protected by a particle filter (84).

4. A system as claimed in claim 2, wherein the base of the chamber (81) of the separator (8) is connected by a bleeding pipe (88) downstream of the non-return valve (86) to a venturi (13) mounted in a pipe (41) linking the liquid measuring device (4) to the dispensing valve (5).

5. A system as claimed in claim 2, wherein the base of the chamber (81) of the separator (8) is connected (89) by the bleeding pipe (85) downstream of the non-return valve (86) to a venturi (14) mounted in a pipe (103) linking the output of the vapour suction pump (10) to the tank (1).

6. A system as claimed in claim 1, wherein the control unit (11) receives data signals 13 from the vapour/liquid separator (8) in order to check that the vapour/liquid separator is operating correctly.

7. A system as claimed in claim 1, wherein the vapour/liquid separator (8) has a float (87) controlling the opening of the bleeding pipe (85) depending on the level of liquid collected in the chamber (81).

8. A system as claimed in claim 7, wherein the float (87) of the separator (8) is fitted with a level sensor selected from the group comprising a magnet and contact pin sensor, a Hall-effect or optical fiber sensor or an optical coupler.

9. A system as claimed in claim 1, wherein the bleeding pipe (85) has a very small diameter so as to operate as a flame arrester.

10. A system as claimed in claim 1, wherein the bleeding pipe (85) is connected to an intake of the pump (2).

* * * * *